US005970722A

United States Patent [19]

Shibata et al.

[11] Patent Number: 5,970,722

[45] Date of Patent: Oct. 26, 1999

[54] AIR CONDITIONING APPARATUS RETURNING REFRIGERATING MACHINE OIL TO COMPRESSOR BY TWO RESTRICTORS AND METHOD OF CONTROLLING AIR CONDITIONING APPARATUS

[75] Inventors: Etsuo Shibata; Katsuhiro Wakahara; Kenji Yao, all of Nara, Japan

[73] Assignee: Sharp Kabushiki Kaisha, Osaka, Japan

[21] Appl. No.: 08/988,964

[22] Filed: Dec. 11, 1997

[30] Foreign Application Priority Data

Dec. 19, 1996 [JP] Japan ..... 8-339566

[51] Int. Cl.[6] ..... F25B 43/02

[52] U.S. Cl. ..... 62/84; 62/468; 62/192

[58] Field of Search ..... 62/468, 470, 192, 62/193, 84

[56] References Cited

U.S. PATENT DOCUMENTS 5,029,455 7/1991 Backus et al. ..... 62/470

FOREIGN PATENT DOCUMENTS

| | | |
|---|---|---|
| 2-154946 | 6/1990 | Japan . |
| 2-287060 | 11/1990 | Japan . |
| 3-51680 | 3/1991 | Japan . |
| 4-45360 | 2/1992 | Japan . |
| 6-26714 | 2/1994 | Japan . |
| 6-288656 | 10/1994 | Japan . |

*Primary Examiner*—John M. Sollecito

[57] ABSTRACT

An air conditioning apparatus includes a compressor, an interior side heat exchanger, an exterior side heat exchanger, an expansion device provided between the interior side heat exchanger and the exterior side heat exchanger, a four-way valve provided between the compressor and the interior side heat exchanger and between the compressor and the exterior side heat exchanger, an oil separator provided between a delivery outlet of the compressor and the four-way valve, a first restrictor and a second restrictor provided between the oil separator and a suction inlet of the compressor, and an open-close valve provided between the second restrictor and the suction inlet of the compressor.

13 Claims, 7 Drawing Sheets

AIR CONDITIONING APPARATUS RETURNING REFRIGERATING MACHINE OIL TO COMPRESSOR BY TWO RESTRICTORS AND METHOD OF CONTROLLING AIR CONDITIONING APPARATUS

BACKGROUND OF THE INVENTION

1. Field of the Invention

The present invention relates to an air conditioning apparatus and a method of controlling thereof. In particular, the invention relates to an air conditioning apparatus in which refrigerating machine oil can be returned sufficiently, and to a method of controlling thereof.

2. Description of the Background Art

A conventional air conditioning apparatus is constituted as shown in FIG. 1. Specifically, the air conditioning apparatus is composed of a compressor 21, a four-way valve 22, an interior side heat exchanger 23, an expansion device 24, an exterior side heat exchanger 25, a refrigerant pipe 26, an interior side blower 27 and an exterior side blower 28.

In this configuration, refrigerant flows as shown by the arrow of the solid line in the case of cooling.

Specifically, the refrigerant discharged from compressor 21 passes through four-way valve 22 and is condensed by exterior side heat exchanger 25. After the heat is discharged into the exterior air, the temperature and pressure of the refrigerant are reduced by expansion device 24. The refrigerant flows into interior side heat exchanger 23, cools the interior air, and evaporates. The evaporated and vaporized refrigerant is passed through four-way valve 22, and sucked into compressor 21.

In the case of heating, the refrigerant flows as shown by the arrow of the dotted line. Specifically, the refrigerant discharged from compressor 21 is passed through four-way valve 22, and condensed by interior side heat exchanger 23. The refrigerant heats the interior air, the temperature and pressure of the refrigerant are reduced by expansion device 24, and the refrigerant flows into exterior side heat exchanger 25. The refrigerant receives heat from the exterior air and evaporates. The evaporated and vaporized refrigerant is passed through four-way valve 22, and sucked into compressor 21.

The refrigerating machine oil is enclosed in compressor 21 for lubrication of the mechanical section. The apparatus has a mechanism by which the refrigerating machine oil is difficult to let flow from compressor 21. However, currently a small amount of refrigerating machine oil is emitted with the refrigerant from compressor 21. Since refrigerant flon (chlorofluoro carbon) 22 currently used by the air conditioning apparatus has compatibility with the refrigerating machine oil, the refrigerating machine oil is melted into the refrigerant, passed through interior side heat exchanger 23 and exterior side heat exchanger 25, and returned to compressor 21. Accordingly, the refrigerating cycle proceeds without trouble.

Due to the problem of destruction of ozonosphere, flon 22 which is HCFC type flon is to be successively reduced during the period from 2004 to 2020. Therefore, the flon should be replaced with HFC type flon or the like of which modulus of destruction of ozonosphere is zero. Three-component type refrigerant R407C (R32/R125/R134a:23/25/52 wt %), two-component type refrigerant R410A (R32/R125:50/50 wt %) are the HFC type flon that are leading substitutes as the refrigerant. However, the compatibility of the substitute refrigerant with mineral oil used as the conventional refrigerating machine oil is poor, and the rate of the refrigerating machine oil emitted from compressor 21, mixed with the refrigerant and returned to the compressor becomes extremely low. As a result, the amount of the refrigerating machine oil in the compressor could be insufficient to cause inadequate lubrication.

As a refrigerating machine oil which has the compatability with the substitute refrigerant described above, refrigerating machine oil of polyester type or polyether type is developed. Although the polyester type refrigerating machine oil has hygroscopicity and is easy to be hydrolyzed, the sludge is often found in case of contamination of any impurities such as the machine oil. Further, although the polyether type refrigerating machine oil has the hygroscopicity, there are unknown factors of the cost and the possibility of supply. Consequently, the refrigerating machine oil is selected out of the conventional mineral oil, the polyester type refrigerating machine oil, the polyether type refrigerating machine oil, and the like. Whichever oil is selected, the compatability with the refrigerant would be poor, and any measures to return the refrigerating machine oil are necessary.

If returning of the refrigerating machine oil is inadequate in a large-sized air conditioning apparatus or the like, the configuration as shown in FIG. 2 is conventionally used. Specifically, a by-pass formed of an oil separator 29 and a restrictor 30 is provided between a delivery outlet and a suction inlet of compressor 21, the refrigerating machine oil contained in the refrigerant discharged from compressor 21 is separated by oil separator 29, the separated refrigerating machine oil is passed through restrictor 30 and sucked into compressor 21. The capillary tube or the expansion valve is used as restrictor 30. If the resistance of flow passage is too high, the refrigerating machine oil does not flow sufficiently. If the resistance of flow passage is too low, a large amount of refrigerant flows and the capacity as the air conditioning apparatus decreases. Therefore, a restrictor having a proper resistance of flow passage is employed.

In a refrigerating cycle in which the compressor operates with a constant speed of rotation, most of the refrigerating machine oil discharged from compressor 21 is separated by oil separator 29, and sucked into compressor 21 in the apparatus above. In the air conditioning apparatus mainly used now, an inverter compressor is used and the capacity control is achieved by controlling the operation frequency of the compressor. In this air conditioning apparatus, if the operation frequency of compressor 21 is low, the refrigerating machine oil discharged from compressor 21 and circulated in the refrigerating cycle is difficult to let return to the compressor 21 due to the low flow velocity of the refrigerant. Consequently, the amount of the refrigerating machine oil in compressor 21 could be insufficient, causing inadequate lubrication.

SUMMARY OF THE INVENTION

One object of the present invention is to provide an air conditioning apparatus in which refrigerating machine oil is sufficiently returned if HFC type flon which is a leading substitute as refrigerant or its mixture is used with the refrigerating machine oil.

Another object of the invention is to provide a method of controlling an air conditioning apparatus by which refrigerating machine oil can be sufficiently returned if HFC type flon which is a leading substitute as refrigerant or its mixture is used with the refrigerating machine oil.

According to one aspect of the invention, an air conditioning apparatus includes: a compressor; an interior side heat exchanger; an exterior side heat exchanger; an expansion device provided between the interior side heat exchanger and the exterior side heat exchanger; a four-way valve provided between the compressor and the interior side heat exchanger and between the compressor and the exterior side heat exchanger; an oil separator provided between a delivery outlet of the compressor and the four-way valve; first and second restrictors provided between the oil separator and a suction inlet of the compressor; and an open-close valve provided between the second restrictor and the suction inlet of the compressor.

Since refrigerating machine oil separated by the oil separator is returned to the compressor through a first by-pass formed of the first restrictor and through a second by-pass formed of the second restrictor and the open-close valve, the refrigerating machine oil discharged from the compressor can be returned without fail.

According to another aspect of the invention, an air conditioning apparatus includes: a compressor; an interior side heat exchanger; an exterior side heat exchanger; an expansion device provided between the interior side heat exchanger and the exterior side heat exchanger; a four-way valve provided between the compressor and the interior side heat exchanger and between the compressor and the exterior side heat exchanger; an oil separator provided between a delivery outlet of the compressor and the four-way valve; a restrictor provided between the oil separator and a suction inlet of the compressor; and a controller which sets an operation frequency of the compressor calculated from load of the air conditioning apparatus and operates the air conditioning apparatus, and if the set operation frequency is lower than a first prescribed frequency, sets the operation frequency of the compressor at a second prescribed frequency after a first prescribed time has passed in an operation time for a second prescribed time.

The controller sets the operation frequency of the compressor at the second prescribed frequency and operates the air conditioning apparatus for the second prescribed time after the first prescribed time has passed in the operation time, if the set operation frequency is lower than the first prescribed frequency. Accordingly, even if the operation frequency of the compressor is low, the refrigerating machine oil discharged from the compressor can be returned without fail.

According to still another aspect of the invention, a method of controlling an air conditioning apparatus including: a compressor; an interior side heat exchanger; an exterior side heat exchanger; an expansion device provided between the interior side heat exchanger and the exterior side heat exchanger; a four-way valve provided between the compressor and the interior side heat exchanger and between the compressor and the exterior side heat exchanger; an oil separator provided between a delivery outlet of the compressor and the four-way valve; first and second restrictors provided between the oil separator and a suction inlet of the compressor; and an open-close valve provided between the second restrictor and the suction inlet of the compressor includes a step of setting an operation frequency of the compressor calculated from load of the air conditioning apparatus and operating the air conditioning apparatus, and a step of controlling the open-close valve based on the operation frequency and operating the air conditioning apparatus.

The open-close valve provided between the second restrictor and the suction inlet of the compressor is controlled based on the operation frequency of the compressor. Accordingly, the refrigerating machine oil can be returned without fail even if refrigerant having a poor compatibility with the refrigerating machine oil is used.

According to still another aspect of the invention, a method of controlling an air conditioning apparatus including: a compressor, an interior side heat exchanger; an exterior side heat exchanger; an expansion device provided between the interior side heat exchanger and the exterior side heat exchanger; a four-way valve provided between the compressor and the interior side heat exchanger and between the compressor and the exterior side heat exchanger; an oil separator provided between a delivery outlet of the compressor and the four-way valve; and one or more restrictor provided between the oil separator and a suction inlet of the compressor includes a step of setting an operation frequency of the compressor calculated from load of the air conditioning apparatus and operating the air conditioning apparatus, and a step of setting, if the set operation frequency is lower than a first prescribed frequency, the operation frequency of the compressor at a second prescribed frequency and operating the air conditioning apparatus after a first prescribed time has passed in an operation time for a second prescribed time.

If the set operation frequency is lower than the first prescribed frequency, the operation frequency of the compressor is set at the second prescribed frequency and operated after the first prescribed time has passed in an operation time for the second prescribed time. Consequently, the refrigerating machine oil can be returned without fail even if the refrigerant has a poor compatibility with the refrigerating machine oil.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

The embodiments of the present invention are hereinafter described in detail according to the figures.

Figure 3:
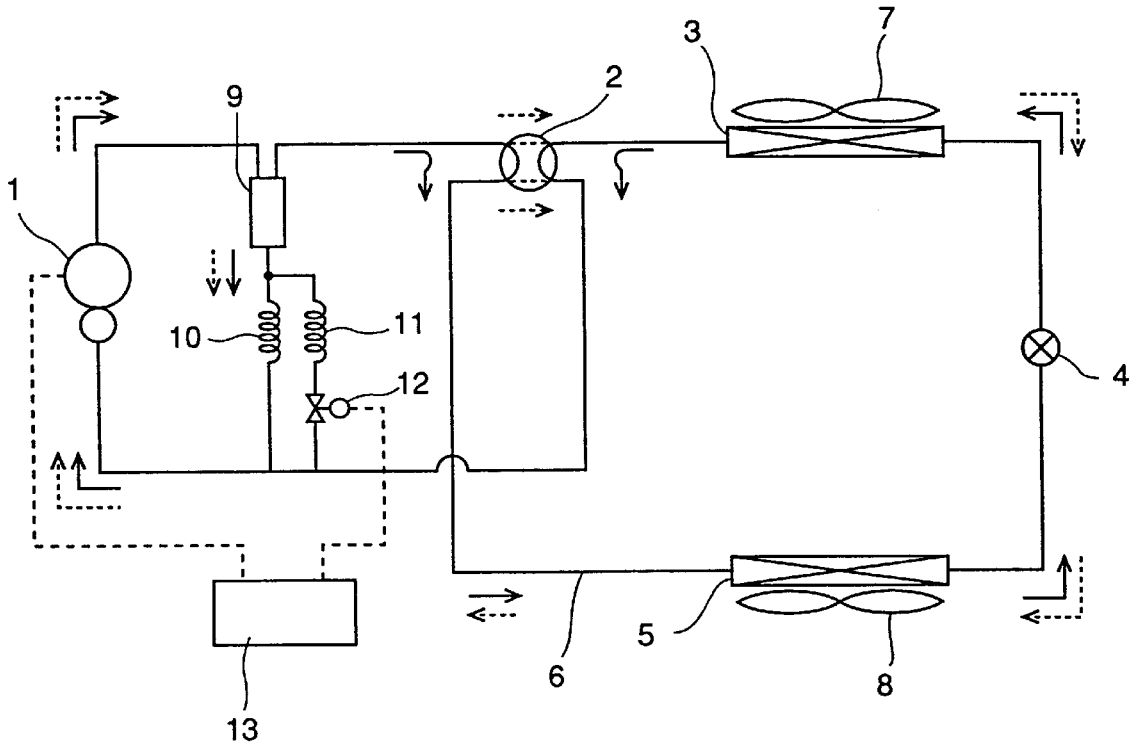
FIG. 3 shows a refrigerating cycle of an air conditioning apparatus according to the present invention.

Referring to FIG. 3, an air conditioning apparatus includes a compressor 1, a four-way valve 2, an interior side heat exchanger 3, an expansion device 4, an exterior side heat exchanger 5, a refrigerant pipe 6, an interior side blower 7, an exterior side blower 8, an oil separator 9, a by-pass formed of a restrictor 10 (hereinafter referred to as a first restrictor), a by-pass formed of a second restrictor 11 provided in parallel with the first restrictor 10 and an open-close valve 12, and a control device 13. A capillary tube or an expansion valve is used for the first restrictor 10 and the second restrictor 11. If the resistance of flow passage of the restrictors 10, 11 is too high, refrigerating machine oil does not flow sufficiently. If the resistance of flow passage of the restrictors 10, 11 is too low, a large amount of refrigerant flows and the capability of the air conditioning apparatus itself declines. Therefore, restrictors having an appropriate resistance of flow passage of the restrictors 10, 11 are employed.

The resistance of flow passage of the first restrictor 10 is made higher than that of the second restrictor 11. Specifically, the resistance of flow passage of the first restrictor 10 corresponds to the resistance when the operation frequency of compressor 1 has a standard to a high value, and the resistance of the second restrictor 11 corresponds to the resistance when the operation frequency of the compressor has a low value. According to the present invention, the operation frequency of compressor 1 is controlled according to the load and operation time of the air conditioning apparatus by control device 13, or open-close valve 12 is controlled according to the operation frequency of compressor 1 by control device 13. An operation of a refrigerating cycle of the present invention is described below.

Cooling Operation

In the case of the cooling operation, refrigerant flows as shown by the arrow of the solid line. Specifically, the refrigerant discharged from compressor 1 is passed through oil separator 9 and four-way valve 2, and condensed by exterior side heat exchanger 5. After the heat is dissipated into the exterior air, the temperature and pressure of the refrigerant are reduced by expansion device 4. The refrigerant flows into interior side heat exchanger 3, cools the interior air and evaporates. The evaporated and vaporized refrigerant is passed through four-way valve 2 and sucked into compressor 1.

Heating Operation

In the case of the heating operation, the refrigerant flows as shown by the arrow of the dotted line. Specifically, the refrigerant discharged from compressor 1 is passed through oil separator 9 and four-way valve 2 and condensed by interior side heat exchanger 3. After the interior air is heated by the refrigerant, the temperature and pressure of the refrigerant are decreased by expansion device 4. The refrigerant flows into exterior side heat exchanger 5, receives heat from the exterior air and evaporates. The evaporated and vaporized refrigerant is passed through four-way valve 2, and sucked into compressor 1. In both cases of the cooling and heating operations, refrigerating machine oil separated by oil separator 9 is sucked into compressor 1 through the first restrictor 10 and the second restrictor 11.

Figure 4:
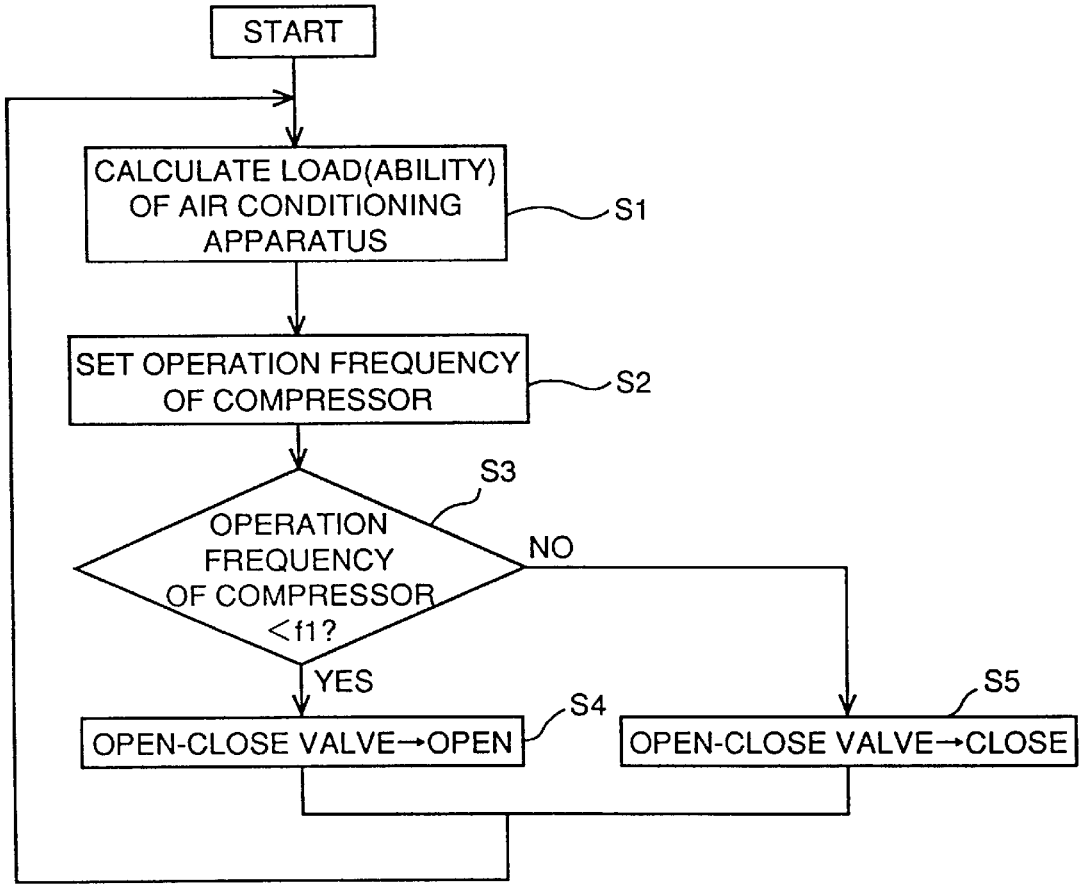
FIGS. 4–7 respectively show flow charts for describing operations of refrigerating cycles of air conditioning apparatuses according to the first to the fourth embodiments of the present invention.

Referring to FIG. 4, control device 13 first calculates load of the air conditioning apparatus (S1), and sets an operation frequency of compressor 1 (S2). Control device 13 compares the operation frequency of compressor 1 with a specified frequency f1. If the operation frequency of compressor 1 equals to or more than the specified frequency f1 (S3, NO), control device 13 closes open-close valve 12 (S5). If the operation frequency is smaller than the specified frequency f1 (S3, YES), control device 13 opens open-close valve 12 (S4).

The operation frequency of compressor 1 is controlled within a range from the minimum frequency $f_{min}$ to the maximum frequency fmax according to the load of the air conditioning apparatus. If the operation frequency of compressor 1 is at least the specified frequency f1, control device 13 closes open-close valve 12, so that the refrigerating machine oil emitted from compressor 1 and separated by oil separator 9 is sucked into compressor 1 through the first restrictor 10. If the operation frequency of compressor 1 is at most the specified frequency f1, control device 13 opens open-close valve 12, so that the refrigerating machine oil discharged from compressor 1 and separated by oil separator 9 is sucked into compressor 1 mainly through the second restrictor 11 having the low resistance of flow passage and open-close valve 12. If the operation frequency of compressor 1 is low, the difference between the pressure of emitting and the pressure of sucking by the compressor is small. However, the resistance of flow passage of the second restrictor 11 is also small so that the refrigerating machine oil can be sufficiently sucked into the compressor.

Second Embodiment

Figure 5:
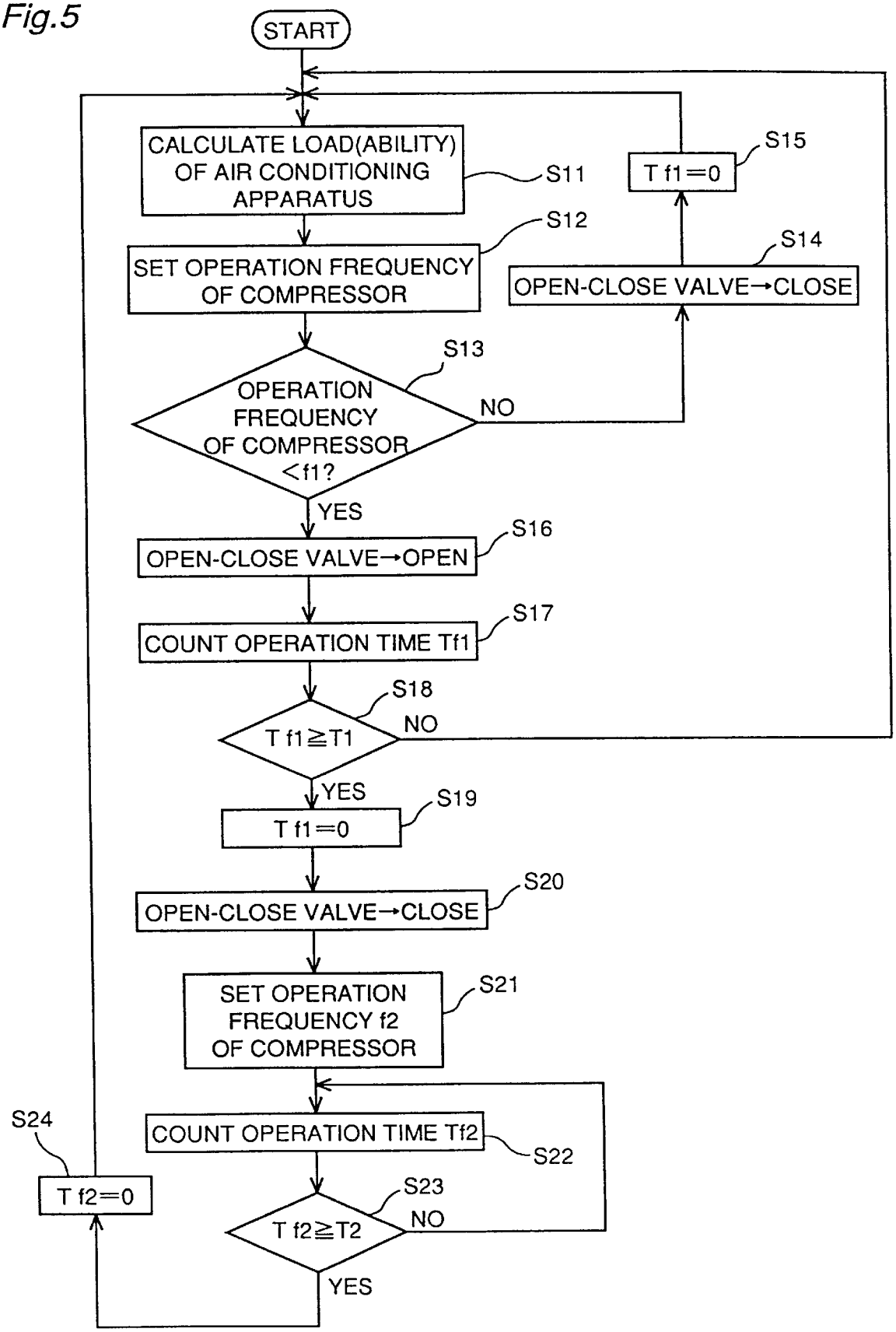

The configuration and refrigerating cycle of an air conditioning apparatus according to the second embodiment are similar to those of the air conditioning apparatus according to the first embodiment shown in FIG. 3. The only difference is the function of control device 13. Detailed descriptions of the similar configuration and function are not repeated here. Referring to FIG. 5, control device 13 first calculates load of the air conditioning apparatus (S11), and sets an operation frequency of compressor 1 (S12).

If control device 13 determines that the operation frequency of compressor 1 is smaller than a first specified frequency f1 (S13, YES), control device 13 opens open-close valve 12 (S16), and starts measuring of an operation time Tf1 of compressor 1 (S17). When operation time Tf1 equals to or more than first specified time T1 (S18, YES), control device 13 clears operation time Tf1 (S19) and closes open-close valve 12 (S20). Control device 13 changes the operation frequency of compressor 1 to a second specified frequency f2 higher than the first specified frequency f1, carries on the operation (S21), and starts measuring of an operation time Tf2 (S22).

When operation time Tf2 at the second specified frequency f2 equals to a second specified time T2 (S23, YES), control device 13 clears operation time Tf2 (S24), and repeats the operation at an operation frequency according to the load of the air conditioning apparatus returning to the step S11. In step S13, if the operation frequency of compressor 1 equals to or more than the first specified frequency f1 (S13, NO), control device 13 closes open-close valve 12 (S14), clears operation time Tf1 (S15), and repeats processes starting from step 11.

Generally, refrigerating machine oil emitted from compressor 1 to be circulated in the refrigerating cycle without being separated by oil separator 10 returns sufficiently if the operation frequency is high. If the operation frequency is low, the refrigerating machine oil is difficult to be returned. In the air conditioning apparatus according to this embodiment, since the operation frequency of compressor 1 is forced to increase temporarily, the refrigerating machine oil can be returned without fail.

Third Embodiment

The configuration and refrigerating cycle of an air conditioning apparatus according to the third embodiment are similar to those of the air conditioning apparatus according to the first embodiment shown in FIG. 3. The only difference is the function of the control device 13. Detailed descriptions of the similar configuration and function are not repeated here.

Figure 6:
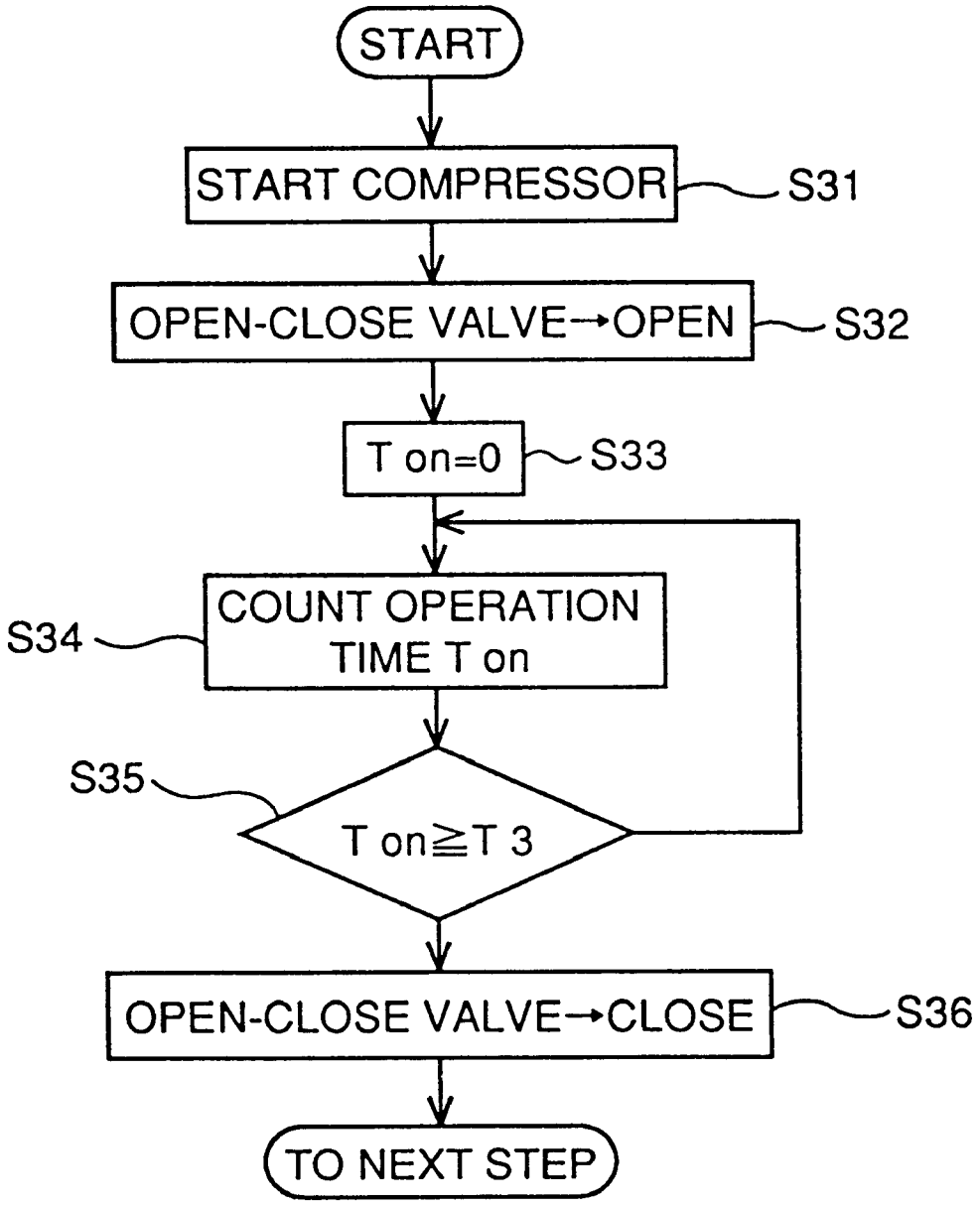

Referring to FIG. 6, when compressor 1 is started (S31), control device 13 opens open-close valve 12 (S32), clears operation time Ton (S33), and starts measuring of operation time Ton after the starting (S34). When operation time Ton equals to a third specified time T3 (S35, YES), control device 13 closes open-close valve 12 (S36). In this embodiment, the refrigerating machine oil is passed through the by-pass including open-close valve 12 having a small resistance of flow passage when compressor 1 is started at which time shortage of the refrigerating machine oil often occurs, so that the refrigerating machine oil can be easily returned. Especially, the refrigerating machine oil can be returned without fail at the starting of compressor 1.

Fourth Embodiment

Figure 1:
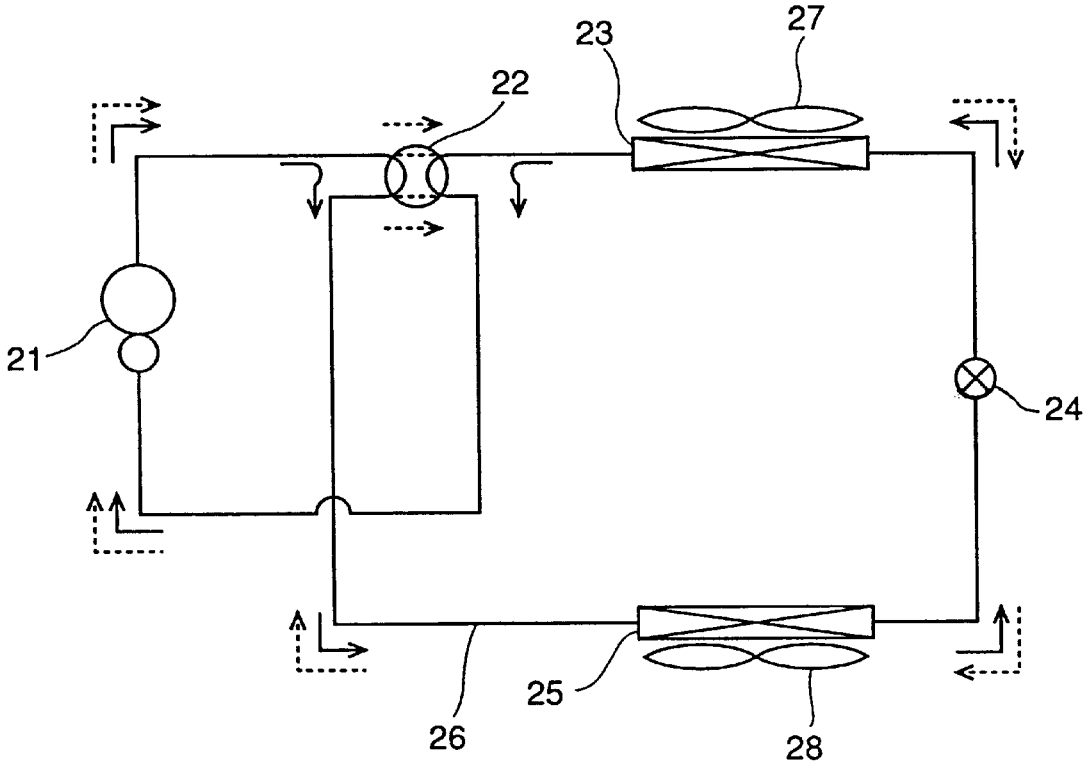
Fig.1 PRIOR ART
FIG. 1 shows one example of a refrigerating cycle of a conventional air conditioning apparatus.
Figure 2:
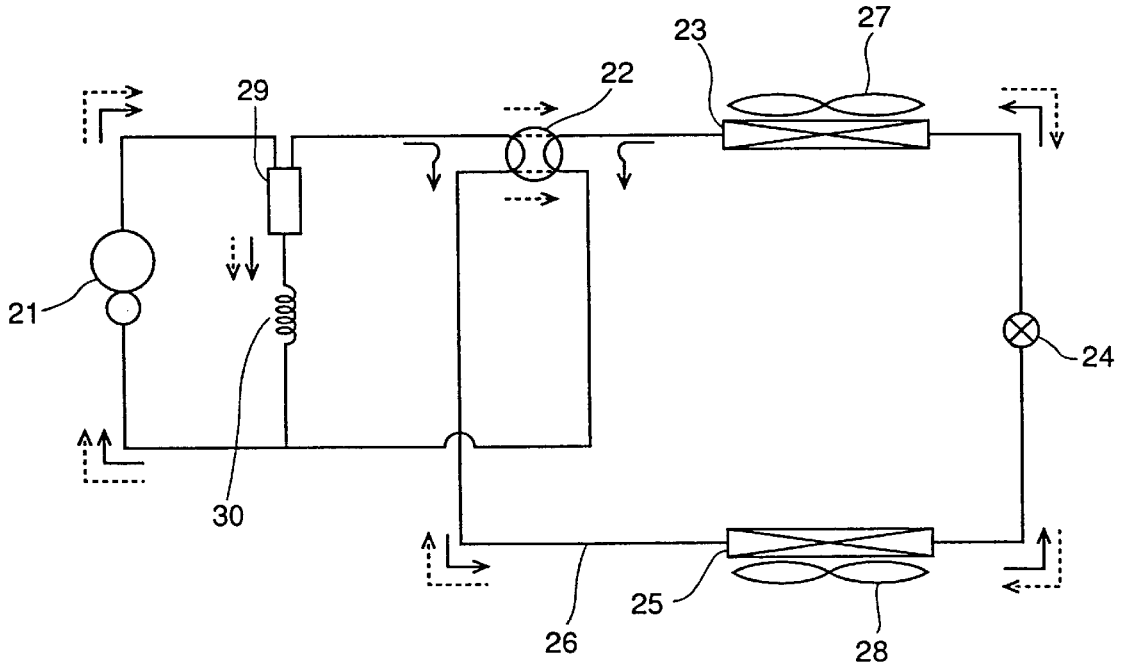
Fig.2 PRIOR ART
FIG. 2 shows another example of a refrigerating cycle of the conventional air conditioning apparatus.

The configuration and refrigerating cycle of an air conditioning apparatus according to this embodiment are similar to those of the air conditioning apparatus of the conventional type shown in FIG. 2. The difference is that the control of compressor 21 is carried out by a control device (not shown). Detailed descriptions of the similar configuration and function are not repeated here.

Figure 7:
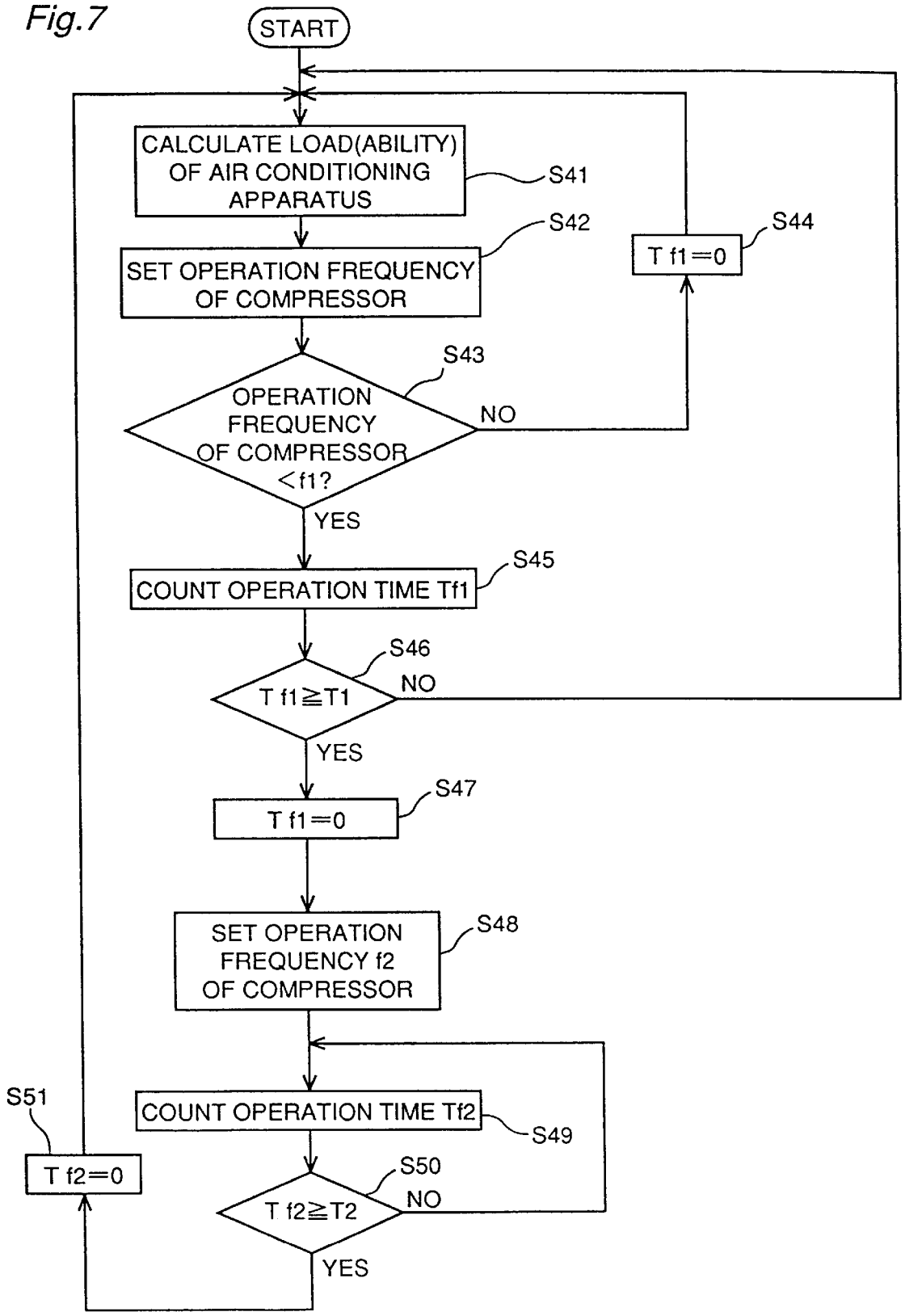

Referring to FIG. 7, the control device first calculates load of the air conditioning apparatus (S41), and sets an operation frequency of compressor 21 (S42).

When the control device determines that the operation frequency of compressor 21 is lower than a first specified frequency f1 (S43, YES), the control device starts measuring of operation time Tf1 of compressor 21 (S45). When operation time Tf1 equals to a first specified time T1 (S46, YES), the control device clears operation time Tf1 (S47), sets the operation frequency of compressor 21 at a second specified frequency f2 which is higher than the first specified frequency f1 (S48), and starts measuring of operation time Tf2 (S49). When operation time Tf2 at the second specified frequency f2 equals to a second specified time T2 (S50, YES), the control device clears operation time Tf2 (S51), repeats the operation at an operation frequency according to the load of the air conditioning apparatus, returning to step 41.

In step S43, if the operation frequency of the compressor equals to or more than the first specified frequency f1 (S43, NO), the control device clears operation time Tf1 (S44), and repeats processes from step S41.

As described above, according to the air conditioning apparatus of the present invention, the refrigerating machine oil can be returned without fail even if the three-component mixture type refrigerant R407C, two-component mixture type refrigerant R410A and the like which are leading substitute refrigerants and have a poor compatibility with the refrigerating machine oil are used.

Further, in selection of the refrigerating machine oil which is difficult when the substitute refrigerant is put to a practical use, the range of selection of the refrigerating machine oil which is suitable as the substitute refrigerant is enlarged to enable mineral oil, oil of polyester type or polyether type which is developed now, and the like to be selected. The refrigerating machine oil which is superior in use and reliability can be employed accordingly.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An air conditioning apparatus comprising:

a compressor;

an interior side heat exchanger;

an exterior side heat exchanger;

an expansion device provided between said interior side heat exchanger and said exterior side heat exchanger;

a four-way valve provided between said compressor and said interior side heat exchanger and between said compressor and said exterior side heat exchanger;

an oil separator provided between a delivery outlet of said compressor and said four-way valve;

a first restrictor and a second restrictor provided between said oil separator and a suction inlet of said compressor; and an open-close valve provided between said second restrictor and the suction inlet of said compressor.

2. The air conditioning apparatus according to claim 1, further comprising a controller which controls said open-close valve based on an operation frequency of said compressor.

3. The air conditioning apparatus according to claim 2, wherein said controller sets an operation frequency of said compressor calculated from load of said air conditioning apparatus and operates the air conditioning apparatus, and opens said open-close valve and operates the air conditioning apparatus if the set operation frequency is lower than a prescribed frequency, and said controller closes said open-close valve and operates the air conditioning apparatus if said set operation frequency is higher than said prescribed frequency.

4. The air conditioning apparatus according to claim 2, wherein said controller sets an operation frequency of said compressor calculated from load of said air conditioning apparatus and operates the air conditioning apparatus, and closes said open-close valve and operates the air conditioning apparatus if the set operation frequency is higher than a first prescribed frequency, and said controller, after opening said open-close valve and operating the air conditioning apparatus for a first prescribed time, sets the operation frequency of said compressor at a second prescribed frequency and closes said open-close valve and operates the air conditioning apparatus for a second prescribed time if said set operation frequency is lower than said first prescribed frequency.

5. The air conditioning apparatus according to claim 4, wherein said second prescribed frequency is higher than said first prescribed frequency.

6. The air conditioning apparatus according to claim 2, wherein said controller opens said open-close valve and operates the air conditioning apparatus when said compressor is started, and closes said open-close valve after a prescribed time has passed in an operation time.

7. An air conditioning apparatus comprising:

a compressor;

an interior side heat exchanger;

an exterior side heat exchanger;

an expansion device provided between said interior side heat exchanger and said exterior side heat exchanger;

a four-way valve provided between said compressor and said interior side heat exchanger and between said compressor and said exterior side heat exchanger;

an oil separator provided between a delivery outlet of said compressor and said four-way valve;

a restrictor provided between said oil separator and a suction inlet of said compressor; and a controller which sets an operation frequency of said compressor calculated from load of said air conditioning apparatus and operates the air conditioning apparatus, and sets, if the set operation frequency is lower than a first prescribed frequency, after a first prescribed time has passed in an operation time, the operation frequency of said compressor at a second prescribed frequency and operates the air conditioning apparatus for a second prescribed time.

8. The air conditioning apparatus according to claim 7, wherein said second prescribed frequency is higher than said first prescribed frequency.

9. A method of controlling an air conditioning apparatus including:

a compressor;

an interior side heat exchanger;

an exterior side heat exchanger;

an expansion device provided between said interior side heat exchanger and said exterior side heat exchanger;

a four-way valve provided between said compressor and said interior side heat exchanger and between said compressor and said exterior side heat exchanger;

an oil separator provided between a delivery outlet of said compressor and said four-way valve;

a first restrictor and a second restrictor provided between said oil separator and a suction inlet of said compressor; and an open-close valve provided between said second restrictor and the suction inlet of said compressor, the method comprising the steps of:

setting an operation frequency of said compressor calculated from load of said air conditioning apparatus and operating the air conditioning apparatus, and controlling said open-close valve based on said operation frequency and operating the air conditioning apparatus.

10. The method of controlling the air conditioning apparatus according to claim 9, wherein the step of controlling said open-close valve based on said operation frequency and operating the air conditioning apparatus includes the steps of opening said open-close valve and operating the air conditioning apparatus if said set operation frequency is lower than a prescribed frequency, and closing said open-close valve and operating the air conditioning apparatus if said set operation frequency is higher than said prescribed frequency.

11. The method of controlling the air conditioning apparatus according to claim 9, wherein the step of controlling said open-close valve based on said operation frequency and operating the air conditioning apparatus includes the steps of closing said open-close valve and operating the air conditioning apparatus if said set operation frequency is higher than a first prescribed frequency, and opening said open-close valve and operating the air conditioning apparatus for a first prescribed time, setting the operation frequency of said compressor at a second prescribed frequency and closing said open-close valve and operating the air conditioning apparatus for a second prescribed time if said set operation frequency is lower than said first prescribed frequency.

12. The method of controlling the air conditioning apparatus according to claim 9, further comprising a step of opening said open-close valve and operating conditioning air conditioning apparatus when said compressor is started, and closing said open-close valve when a prescribed time has passed in an operation time.

13. A method of controlling an air conditioning apparatus including:

a compressor;

an interior side heat exchanger;

an exterior side heat exchanger;

an expansion device provided between said interior side heat exchanger and said exterior side heat exchanger;

a four-way valve provided between said compressor and said interior side heat exchanger and between said compressor and said exterior side heat exchanger;

an oil separator provided between a delivery outlet of said compressor and said four-way valve; and a restrictor provided between said oil separator and a suction inlet of said compressor, the method comprising the steps of:

setting an operation frequency of said compressor calculated from load of said air conditioning apparatus and operating the air conditioning apparatus; and setting, if said set operation frequency is lower than a first prescribed frequency, after a first prescribed time has passed in an operation time, the operation frequency of said compressor at a second prescribed frequency and operating the air conditioning apparatus for a second prescribed time.

* * * * *